US007988763B2

(12) United States Patent
Tremblay et al.

(10) Patent No.: US 7,988,763 B2
(45) Date of Patent: Aug. 2, 2011

(54) USE OF A BINARY SALT FLUX OF NACL AND $MGCL_2$ FOR THE PURIFICATION OF ALUMINIUM OR ALUMINIUM ALLOYS, AND METHOD THEREOF

(75) Inventors: Sylvain Tremblay, Chicoutimi (CA); Luc Desrosiers, Sherbrooke (CA); Daniel Levesque, Sherbrooke (CA)

(73) Assignee: Pyrotek Inc., Spokane Valley, WA (US)

( * ) Notice: Subject to any disclaimer, the term of this patent is extended or adjusted under 35 U.S.C. 154(b) by 0 days.

(21) Appl. No.: 12/480,010

(22) Filed: Jun. 8, 2009

(65) Prior Publication Data

US 2010/0307293 A1 Dec. 9, 2010

(51) Int. Cl.
*C22B 21/06* (2006.01)

(52) U.S. Cl. ..... 75/682; 75/685

(58) Field of Classification Search ..... 75/685, 75/682, 308, 329
See application file for complete search history.

(56) References Cited

U.S. PATENT DOCUMENTS

| | | | | |
|---|---|---|---|---|
| 1,377,374 | A | 5/1921 | Veazey | |
| 1,476,192 | A | 12/1923 | Veazey | |
| 1,519,128 | A | 12/1924 | Gann | |
| 1,534,105 | A | 4/1925 | Gann | |
| 1,754,788 | A | 4/1930 | Gann | |
| 1,975,084 | A * | 10/1934 | Davies | 75/307 |
| 1,989,456 | A | 1/1935 | Luschenowsky | |
| 2,073,018 | A * | 3/1937 | Lepp | 75/604 |
| 2,262,105 | A | 11/1941 | Rowland et al. | |
| 2,497,540 | A | 2/1950 | Emley | |
| 2,654,670 | A | 10/1953 | Davis et al. | |
| 3,189,491 | A | 6/1965 | Robbins | |
| 3,650,730 | A | 3/1972 | Derham et al. | |
| 4,053,304 | A | 10/1977 | Tsuda | |
| 4,099,965 | A | 7/1978 | Beguin et al. | |
| 4,138,245 | A * | 2/1979 | Stary | 75/681 |
| 4,261,746 | A | 4/1981 | Langston et al. | |
| 4,295,884 | A | 10/1981 | Hicter et al. | |
| 4,451,287 | A | 5/1984 | Bauer et al. | |
| 4,501,614 | A | 2/1985 | Bauer et al. | |
| 4,695,320 | A | 9/1987 | Christini et al. | |
| 4,790,873 | A * | 12/1988 | Gesing et al. | 75/407 |

(Continued)

FOREIGN PATENT DOCUMENTS

JP 57051230 A * 3/1982

OTHER PUBLICATIONS

Derwent Acc-No. 1982-36138E for JP 57051230 A published Mar. 26, 1982.*

(Continued)

*Primary Examiner* — George Wyszomierski
*Assistant Examiner* — Tima M McGuthry-Banks
(74) *Attorney, Agent, or Firm* — Choate, Hall & Stewart LLP; Charles E. Lyon; Kristen C. Buteau

(57) ABSTRACT

A method for the purification of a metal selected from the group consisting of aluminum and aluminum alloys, wherein the metal is in a liquid phase and is contacted with a salt flux consisting of a binary mixture of NaCl and $MgCl_2$. Preferably, more than 22% by weight of the binary mixture consists of NaCl.

34 Claims, 4 Drawing Sheets

U.S. PATENT DOCUMENTS

| | | | | |
|---|---|---|---|---|
| 4,808,222 | A | 2/1989 | Reeve-Parker | |
| 5,405,427 | A | 4/1995 | Eckert | |
| 6,053,959 | A | 4/2000 | Ireland | |
| 6,171,362 | B1 | 1/2001 | Osumi et al. | |
| 6,206,950 | B1 | 3/2001 | Ireland | |
| 6,379,418 | B2 | 4/2002 | Ireland | |
| 6,936,089 | B2 | 8/2005 | Fujimoto et al. | |
| 7,537,639 | B2 * | 5/2009 | De Vries et al. | 75/588 |

OTHER PUBLICATIONS

DeYoung, David H. "Salt Fluxes for Alkali and Alkaline Earth Element Removal from Molten Aluminum," 7th Australian Asian Pacific Conference, Alulminum Cast House Technology, pp. 99-113, 2001.*

International Search Report and Written Opinion for PCT/CA2010/000866, mailed Sep. 24, 2010.

Courtenay et al., "A new Insight into the Melting Behaviour and Performance of Fused $MgCl_2$/KCl refining fluxes," *Aluminium International Today* 20, No. 2:24-26 (2008).

Chesonis et al., "Chloride Salt Injection to Replace Chlorine in the Alcoa A622 Degassing Process," *Light Metals* pp. 569-574 (2008).

Majidi et al., "Study of fluxing temperature in molten aluminum refining process," *Journal of Materials Processing Technology* 182:450-455 (2007).

Ahmed et al., "Elimination of Chlorine at the Aluminium Bahrain Casthouses," *Aluminium Cast House Technology*, pp. 25-30 (2007).

Ohm et al., "Process Improvement by application of Innovative Fused Fluxes," *Aluminum Cast House Technology*, pp. 199-208 (2007).

Deyoung et al., "Air Emissions from Rotary Gas and Rotary Salt Injection Furnace Fluxing Processes," *Aluminum Cast House Technology*, pp. 7-16 (2005).

Zhou et al., "Performance improvement of industrial pure aluminum treated by stirring molten fluxes," *Materials Science and Engineering* A347:280-290 (2003).

Bridi et al., "Improvement in Casthouse Processing Using In-Furnace Refining Systems," *8th Aluminum Cast House Technology Conference*, pp. 1-15 (2003).

Tenorio et al., "Effect of salt/oxide interaction on the process of aluminum recycling," *Journal of Light Metals* 2:89-93 (2002).

Gallo et al., "Development, Evaluation and Application of Solid Fluxes," *Modern Casting*, pp. 30-33 (2002).

Deyoung, "Salt Fluxes for Alkali and Alkaline Earth Element Removal from Molten aluminum," *7th Australian Asian Pacific Conference Aluminum Cast House Technology*, pp. 99-113 (2001).

Williams, "Alkali Removal and Reduced Chlorine use during Furnace Fluxing," Light Metals pp. 1053-1059 (2001).

Utigard et al., "Properties of Fluxes used in Molten Aluminum Processing," *High Temperature Materials and Processes* 20 Nos. 3-4, pp. 303-307 (2001).

Ohno, "The Latest Molten Metal Refining Processes in Cast Shop," *Journal of Japan Institute of Light Metals* 51:134-137 (2001).

Utigard et al., "The Roles of Molten Salts in the Treatment of Aluminum," *Canadian Metallurgical Quaterly* 40 No. 3, pp. 327-334 (2001).

Williams et al., Removal of Alkali Metals from Aluminum, *Light Metals* pp. 785-793 (2000).

Beland et al., "Rotary Flux Injection: Chlorine-Free Technique for Furnace Preparation," *Light Metals* pp. 843-847 (1998).

Roy et al., "The role of Salt Flux in Recycling of Aluminum," *Light Metals* pp. 1237-1243 (1998).

Roy et al., "Inclusion Removal during Chlorine Fluxing of Aluminum Alloys," *Light Metals*, pp. 871-875 (1998).

Utigard et al., "The properties and Uses of Fluxes in Molten Aluminum Processing," *JOM*, 50:38-43 Nov. 1998.

Crepeau, "Molten Aluminum Contamination, Gas, Inclusions and Dross," *Modern Casting*, pp. 39-41Jul. 1997.

Tenorio et al., "Optimization of Salt Composition in the Recycling of Aluminum Cans," *Light Metals*, pp. 1105-1108 (1997).

Friesen et al., "Coalescence Behaviour of Aluminum Droplets Under a Molten Salt Flux Cover," *Light Metals*, pp. 857-864 (1997).

Samuel et al., "Fluxing of a 359/SiC/10p composite with alkali chlorides: effect of inclusions," *Journal of Materials Science* 31:43-48 (1996).

Beland et al., "Improving Fluxing of Aluminum Alloys," *Light Metals*, pp. 1189-1195 (1995).

Crepeau et al., "Solid Fluxing Practices for Aluminum Melting," *Modern Casting*, pp. 28-30 Jul. 1992.

Stevens, et al., "Mechanisms of Sodium, Calcium and Hydrogen Removal from an Aluminum Melt in a Stirred Tank Reactor—The Alcoa 622 Process," *Light Metals* pp. 437-443 (1988).

Robelin et al., "Thermodynamic evaluation and optimization of the ($NaCl+KCl+MgCl_2+CaCl_2+MnCl_2+FeCl_2+CoCl_2+NiCl_2$) system," *Journal of Chemical Thermodynamics* 36:809-828 (2004).

Chartrand et al., "Thermodynamic Evaluation and Optimization of the $LiCl-NaCl-KCl-RbCl-CsCl-MgCl_2-CaCl_2$ System Using the Modified Quasi-chemical Model," *Metallurgical and Materials Transactions* 32A:1361-1383 Jun. 2001.

Perry et al., "The Magnesium Chloride-Potassium Chloride Phase Diagram," *Journal of Phase Equilibria* 14, No. 2, pp. 172-178 (1993).

Lin et al., "Computation of Ternary Salt Phase Diagrams," *Journal of the American Ceramic Society* 62, Nos. 7-8, pp. 414-422 (1979).

Gibbons et al., "Crystal Structures of $K_2MgCl4$ and $Cs_2MgCl_4$," *Canadian Journal of Chemistry* 53:114-118 (1975).

R. Bridi, *Substitution of Chlorine as a Furnace Addition in Aluminum Industry Cast Houses by Fused Refining Agents*, Proceedings of the 6th Australian Asian Pacific Conference on Aluminum Cast House Technology held Jul. 26-29, 1999, Novotel Brighton Beach, Sidney, Australia, 9 pages.

Foseco Brochure, *Development, Evaluation and Application of Granular and Powder Fluxes in Transfer Ladles, Crucible and Reverberatory Furnaces*, Proceedings of the 6th International Conference on Molten Aluminum Processing held Nov. 11-13, 2001, Orlando, FL, pp. 8-16.

Foseco Brochure, *Granular Fluxes for Aluminum Alloys, Environmental and technological Advances*, Proceedings of the 4th International Conference on Molten Aluminum Processing held Nov. 12-14, 1995, Orlando, FL, pp. 16-20.

Quackenbush et al., *Testing and Alternative Method for Treating Molten Aluminum at Florida Extruders*, Presented at a Pyrotek Sales Conference, Jun. 2002, 9 pages.

Gruzleski et al., "The Treatment of Liquid Aluminum-Silicon Alloys," *American Foundrymen's Society, Inc.* pp. 204-205 (1990).

Office Action mailed from CIPO on Jan. 6, 2011 in Canadian Application No. 2,668,473.

* cited by examiner

USE OF A BINARY SALT FLUX OF NACL AND $MGCL_2$ FOR THE PURIFICATION OF ALUMINIUM OR ALUMINIUM ALLOYS, AND METHOD THEREOF

FIELD OF THE INVENTION

The invention relates to the use of a binary salt flux comprising NaCl and $MgCl_2$ for the purification of a metal selected from the group consisting of aluminum and aluminum alloys, more particularly for the removal of alkali and alkaline-earth metals. The invention also relates to a method for the purification of said metal with said binary salt flux.

BACKGROUND OF THE INVENTION

The use of fluxes is well known in the field of metallurgy and these fluxes fulfill various functions.

Fluxes can be used to form a protecting layer at the surface of an alloy to prevent oxidation. When fluxes contain chemical active agents, they can be used to clean furnace walls by softening accumulated layers of corundum. Some exothermic fluxes are also used for cleaning dross and removing aluminum trapped in oxide layers.

Fluxes that are based on alkali chlorides and alkaline-earth chlorides are also used for the refining of alloys. Those skilled in the art generally define refining as the removal of alkali and alkaline-earth metals, non metallic inclusions and hydrogen from the alloys.

Sodium and calcium are always present as impurities in aluminum obtained from the Hall-Héroult process. Lithium fluoride is often added to the electrolytic bath to improve the efficiency of cells. However, a small amount in the metallic state is found dissolved in the aluminum. These impurities entail quality issues. For example, in an alloy containing magnesium, the presence of sodium may interfere during the hot rolling processes. The presence of sodium in aluminum and silicon alloys neutralize the effect of phosphorus used for the refining of grains. For the above-mentioned reasons, the use of fluxes containing sodium is not recommended for aluminum and its alloys, more particularly for aluminum alloys comprising a magnesium content higher than 3% by weight or a silicon content higher than 10% by weight.

Also, the presence of hydrogen in too high concentration may lead to a too high porosity of the aluminum during its solidification. During the recycling of aluminum, the presence of non metallic inclusions is important.

Reactional kinetics for the withdrawal of calcium and sodium in an aluminum alloy have been well studied. Naturally, in these alloys, both impurities disappear according to a kinetic of order 1 for small concentrations and order 0 for high concentrations. Because of its high vapor tension, sodium oxidizes itself more rapidly than calcium, that is why calcium is used during cleaning tests. The addition of fluxes involves an increase of reactional constants and thereby a faster reduction of the content in impurities. Mixing also has a non negligible effect on the reduction of impurities. Mixing accelerates the withdrawal of impurities by increasing the contact between impurities and the salt flux.

$MgCl_2$ is one of the chemical active agents used for the withdrawal of impurities in alloys. Its concentration has a direct effect on the kinetic of withdrawal of calcium and sodium. Its melting point is 714° C., but in common fluxes, it is mixed with other salts to obtain a melting point between 400 and 550° C. However, $MgCl_2$ is hygroscopic and can not be exposed for a long period of time to the surrounding air.

Fluxes obtained by fusion of salts comprising magnesium chloride have hygroscopic properties. Consequently, the packaging is an important factor in limiting the absorption of humidity during the manufacturing of such fluxes.

There are examples of fluxes that are based on magnesium chloride. U.S. Pat. No. 1,377,374 relates to the use of a flux having an equimolar composition of sodium chloride and magnesium chloride for the production of manganese or magnesium alloys. U.S. Pat. No. 1,754,788 relates to the use of this same flux in a process for the cleaning of magnesium. U.S. Pat. No. 1,519,128 relates to the addition of calcium chloride to this composition and U.S. Pat. No. 2,262,105 relates to the addition of potassium chloride and magnesium oxide in addition to the calcium chloride. U.S. Pat. No. 5,405,427 mentions a flux based on sodium chloride, magnesium chloride, potassium chloride and carbon for the treatment of metal.

The article entitled "Salt Fluxes for Alkali and Alkali and Alkaline Earth Element Removal from Molten Aluminum" by David H. DeYoung shows the use of a ternary salt based on magnesium chloride, sodium chloride and potassium chloride for the removal of sodium, calcium and lithium from aluminum alloys. However, the article entitled "The Treatment of Liquid Aluminum-Silicon Alloys" by Gruzleski et al., pp. 204-205 indicates that it is important to those skilled in the art, not to use fluxes containing sodium salts. Therefore, even if a ternary flux salts having low content in sodium salts may be tolerated, those skilled in the art are expressly invited to avoid using sodium salts.

Initially, the refining of aluminum was carried out by bubbling of chlorine and argon in the liquid metal. However, this created environmental problems due to emissions of chlorine, chlorhydric acid and particles in suspension. The use of salt fluxes was later adopted as a more ecologically-friendly solution.

The refining fluxes are usually composed of alkali chlorides or alkaline-earth chlorides, which are mixed to obtain melting points that are lower than the operating temperature of alloys—the melting point of pure compounds being usually quite high.

Several methods can be used to incorporate salt fluxes in an alloy. U.S. Pat. No. 4,099,965 relates to a method where a flux of KCl and $MgCl_2$ is added in solid form in the bottom of a preheated container before the addition of aluminum. More currently, fluxes are added by an inert gas in a pipe under the surface of the metal (lance fluxing). Recently, a method was developed where a hollow shaft brings the salt flux in the alloy with a gas carrier, and the salt flux is dispersed by an agitator (rotary flux injection). This method reduces the amount of salt flux required for carrying out the purification while increasing the dispersion of this salt flux in the alloy. Following the addition of a salt flux to the metal, impurities and salts float on the surface of the liquid metal and can be easily removed.

Advantageously, the use of solid compounds obtained by melting of salts controls the granulometry. Particles may be used in batch processes or in continuous processes.

However, costs related to salt fluxes such as binary mixtures of magnesium chloride and potassium chloride, are high. Furthermore, the use of salt fluxes having a substantial content in sodium chloride is not recommended by those skilled in the art due to perceived negative effects of sodium content in the resulting aluminum or aluminum alloys. In fact, when sodium chloride is present in fluxes for the purification of aluminum or aluminum alloys, those skilled in the art currently will avoid or limit the use of sodium chloride. More particularly, in the case of certain kinds of alloys such as, for example, aluminum alloys having silicon content higher than 10% by weight and more particularly aluminum alloys having magnesium content higher than 3% by weight, those skilled in the art currently recommend not using sodium chloride in salt flux.

During Applicant's search for a more effective solution to the purification problem, it was surprisingly noted that contrary to current apprehensions and beliefs of those skilled in the art, it is possible in a salt flux containing $MgCl_2$, to replace expensive KCl by inexpensive NaCl. Consequently, the present invention offers an economical solution for the treatment of aluminum or aluminum alloys with an efficiency of purification that is equivalent to methods presently used. Indeed, contrary to apprehensions of those skilled in the art, there is no significant amount of sodium in the resulting aluminum or aluminum alloys when using the inventive purification method described herein.

Embodiments of the present invention show the following advantages:

- Economical advantages
  - Lower production costs because the melting point of the flux is lower.
  - Lower costs of raw material.
- Efficiency equivalent to the purification methods using an existing well known salt flux sold under the trademark Promag (40 wt % KCl-60 wt % $MgCl_2$).
- Economical alternative to existing product sold under the trademark Promag without creating any significant accumulation of sodium within aluminum or aluminum alloys.

SUMMARY OF THE INVENTION

A first preferred aspect of the invention relates to the use of a salt flux for the purification of a metal selected from the group consisting of aluminum and aluminum alloys, said metal being in liquid phase and said salt flux being a binary mixture of NaCl and $MgCl_2$.

A second preferred aspect of the invention relates to a method for the purification of a metal selected from the group consisting of aluminum and aluminum alloys, wherein said method comprises:

- heating the metal to a liquid phase; and
- contacting the liquid metal with a salt flux consisting of a binary mixture of NaCl and $MgCl_2$.

Another embodiment of the invention relates to a use or a method as defined hereinabove, wherein more than 22% by weight of said binary mixture consists of NaCl.

Another embodiment of the invention relates to a use or a method as defined hereinabove, wherein the salt flux:

- is a binary mixture of particles of NaCl and particles of $MgCl_2$; or
- consists of particles resulting from the grinding of a fused salt of NaCl and $MgCl_2$ in solid state; or
- is a liquid mixture of NaCl and $MgCl_2$.

Another embodiment of the invention relates to a use or a method as defined in any one of the above-mentioned embodiments, wherein the binary mixture comprises: a) from 40 to 50% by weight of NaCl; and b) from 50 to 60% by weight of $MgCl_2$. More particularly, this binary mixture comprises 45% by weight of NaCl and 55% by weight of $MgCl_2$ to form an eutectic mixture having a melting point of about 439° C.

Another embodiment of the invention relates to a use or a method as defined in any one of the above-mentioned embodiments, wherein when the salt flux is in the form of particles, those particles have an average particle size between 100 μm and 3.35 mm. Preferably, said particles may have a particle size between 0.85 mm and 3.15 mm or between 100 μm and 1 mm.

Another embodiment of the invention relates to a use or a method as defined in any one of the above-mentioned embodiments, wherein the particles are contacted with the liquid metal by injection with a gas injection equipment. A non limiting example of a gas injection equipment may consist of a rotary injector known under the trade name SNIF PHD-50 commercialized by the Applicant.

Another embodiment of the invention relates to a use or a method as defined in any one of the above-mentioned embodiments, wherein the metal is an aluminum alloy having a magnesium content higher than 3% by weight.

Another embodiment of the invention relates to a use or a method as defined in any one of the above-mentioned embodiments, wherein the metal is an aluminum alloy having a silicon content higher than 10% by weight.

BRIEF DESCRIPTION OF THE DRAWINGS

The present invention will be better understood with reference to the following drawings.

Figure 1:
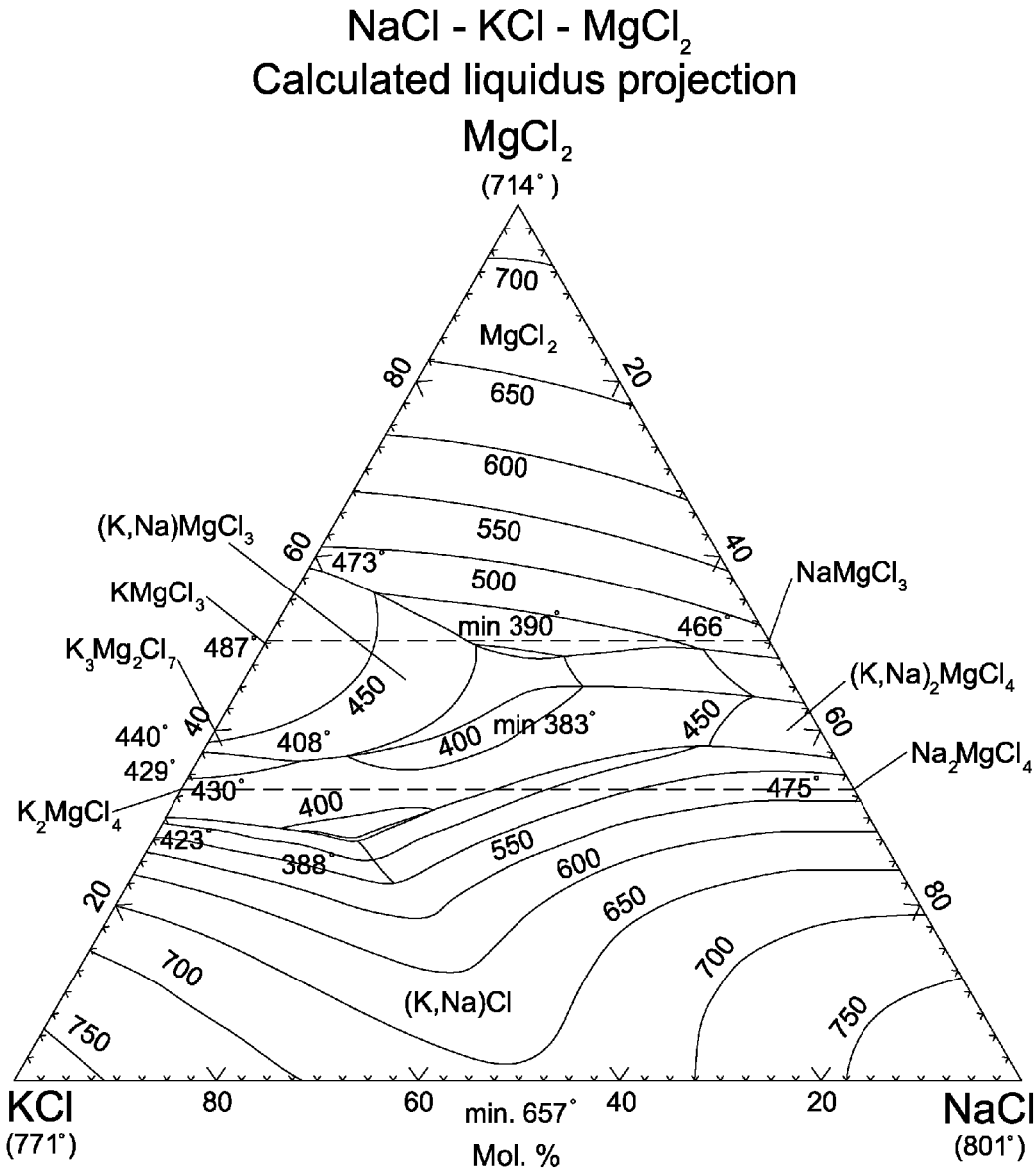
FIGURE 1 (PRIOR ART)
FIG. 1: a phase diagram of a fused salt $KCl/NaCl/MgCl_2$.
Figure 2:
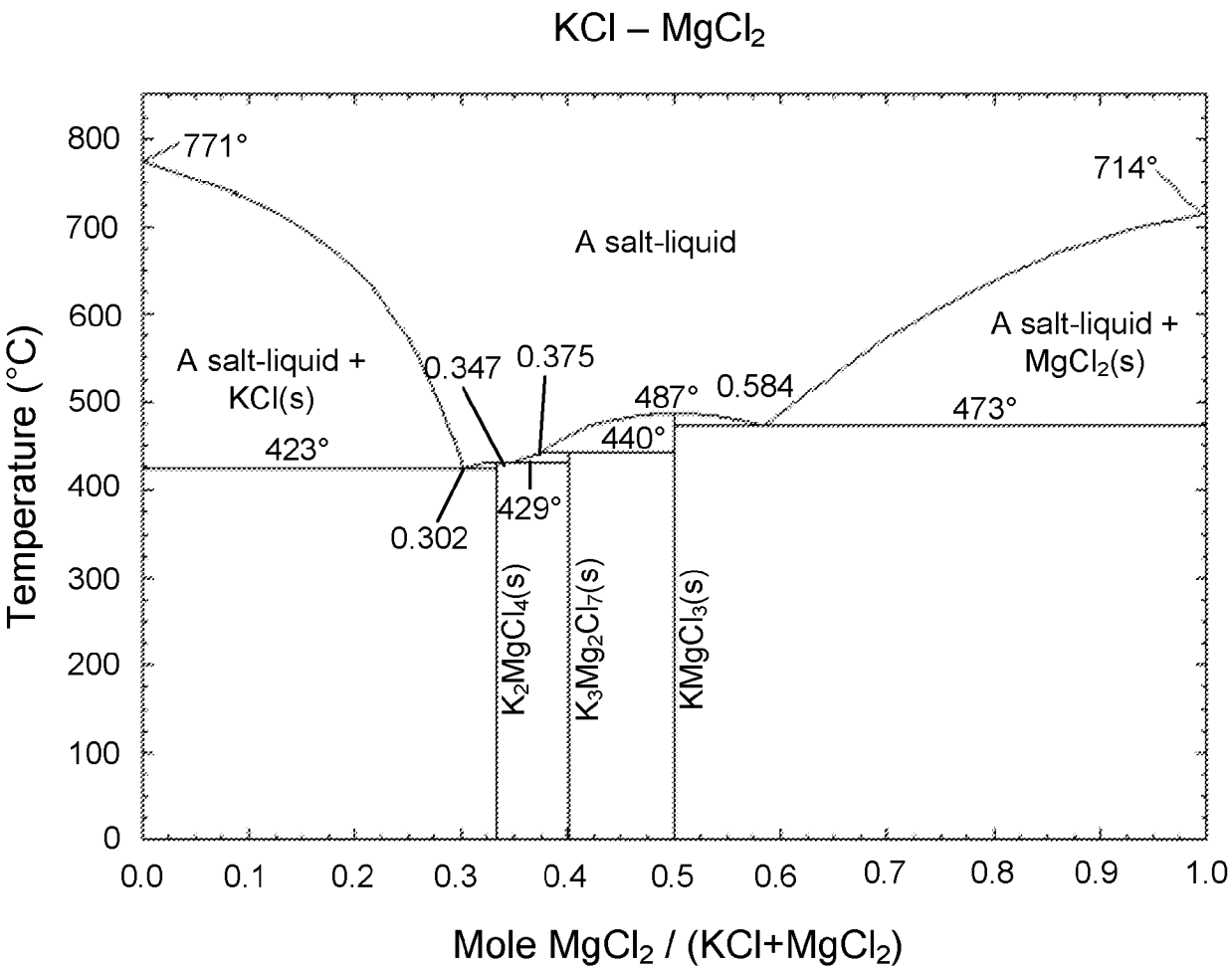
FIGURE 2 (PRIOR ART)
FIG. 2: a phase diagram of a fused salt $KCl/MgCl_2$.
Figure 3:
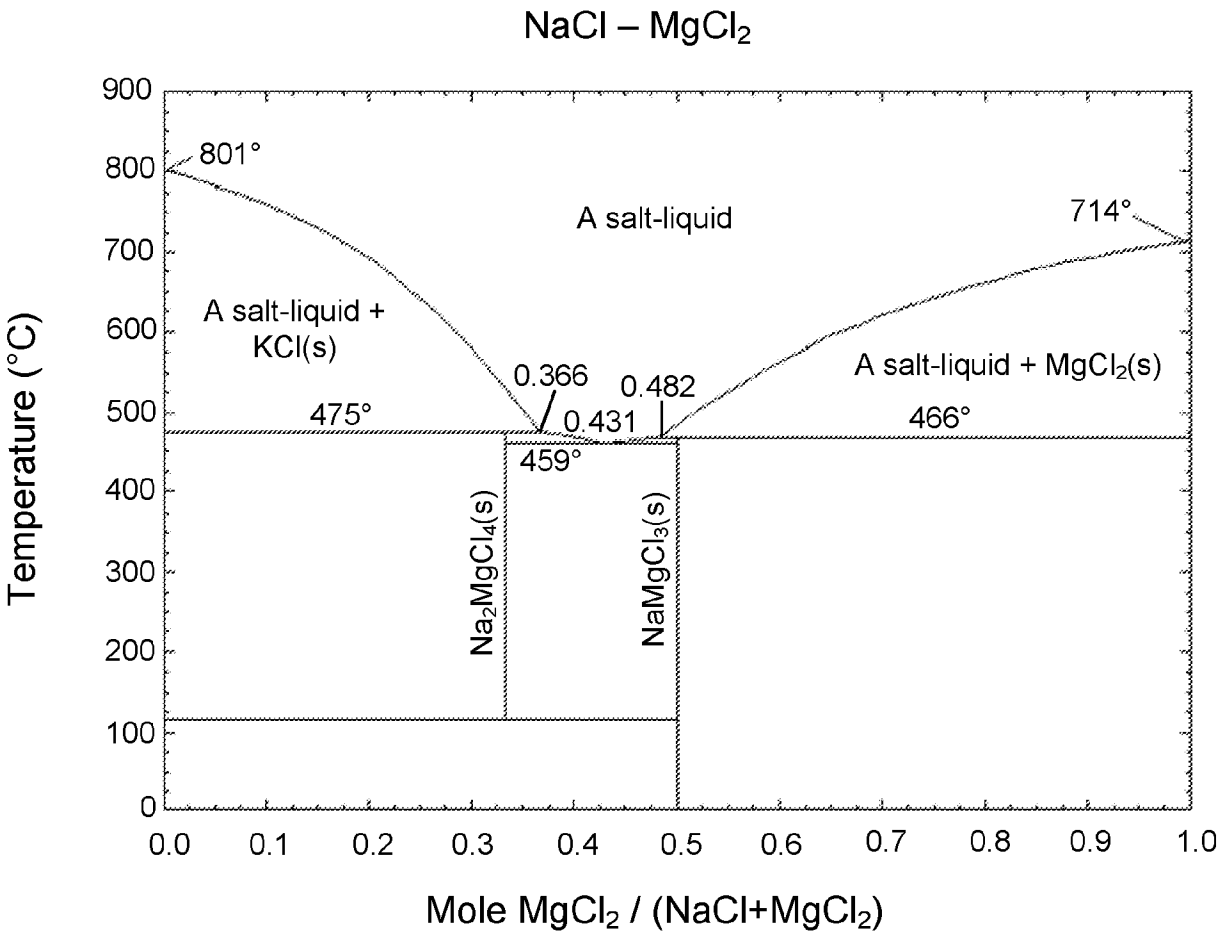
FIGURE 3 (PRIOR ART)
FIG. 3: a phase diagram of a fused salt $NaCl/MgCl_2$.

Phase diagrams of FIGS. 1 to 3 were extracted from factsage web site (http://factsage.com).

DESCRIPTION OF EMBODIMENTS OF THE INVENTION

In the following examples, the Applicant has noted, contrary to apprehensions of those skilled in the art, that formulations of salt fluxes comprising a binary mixture of NaCl and $MgCl_2$ do not involve an increase of the concentration of metallic sodium in an aluminum alloy having magnesium content. A non limiting example of such an aluminum alloy may consist of an aluminum alloy having a magnesium content of 5% by weight. Consequently, it appears that there is no counter-indication of using a binary salt flux comprising NaCl and $MgCl_2$ for cleaning aluminum, especially in the case of an aluminum alloy with high magnesium content.

Formulations based on NaCl and $MgCl_2$ proposed according to the present invention, show melting points that are lower than those of salt flux compositions sold by the Applicant under the trademark Promag (40 wt % KCl, 60 wt % $MgCl_2$), for equivalent amounts of $MgCl_2$ which is the chemically active agent for the withdrawal of impurities. The lowering of melting points represents a lowering of energy costs when melting the solid salt flux.

Two fused salts have been evaluated in examples hereinafter, that is (on a weight basis) the following binary system salt flux and ternary system salt flux (prior art):

- 45% NaCl and 55% $MgCl_2$ with a melting point of 439° C.; and
- 20% NaCl, 20% KCl and 60% $MgCl_2$ with a melting point of 396° C.

Also, example 1 illustrates an unexpected effect with regard to the sodium concentration in an aluminum alloy when NaCl is added in a liquid aluminum alloy, that is, no increase of the sodium content in the alloy obtained.

Preparation of each salt flux was made by mixing the salts in an anhydrous solid phase in an appropriate oven. Then, by increasing the temperature of the oven, a fused compound in liquid form was obtained. The liquid was then cooled down quickly, grinded and sifted to obtain a granulometry that was appropriate for the selected method. In example 7 hereinafter, the salt flux was made only by mixing the salts in an anhydrous solid phase.

Salt fluxes have shown an optimal efficiency for the withdrawal of Ca, Na and Li when used with a rotary injector such as a SNIF PHD-50 (tradename) commercialized by the Applicant (Pyrotek). Of course, other methods of addition well known to those skilled in the art and already mentioned for use in connection with prior art purification methods can be used to carry out the purification. The concentrations of salt fluxes required to carry out the purification may vary depending on the selected method.

EXAMPLE 1

In a crucible made of graphite, one hundred grams (100 g) of NaCl in powder form and sold under the trademark SIFTO INDUSTRIAL were agitated in 1.5 kg of a liquid AA110 aluminum (sold under the trademark Alcan) in which 5 wt % of solid magnesium were added. The crucible was maintained at 850° C. during the whole test. Samples were taken every day during 7 days. According to these daily analyses, the sodium content of the resulting aluminum alloy was at a minimal level of 2 ppm during the whole test, showing that, contrary to apprehensions of those skilled in the art, an addition of NaCl does not involve an absorption of sodium in an aluminum alloy with high magnesium content.

EXAMPLE 2

In a graphite crucible, fifteen grams (15 g) of a salt flux consisting of a binary mixture of 45 wt % NaCl and 55 wt % $MgCl_2$ were agitated in 1.5 kg of a liquid AA1100 aluminum alloy (sold under the trademark Alcan) in which 5 wt % of magnesium were added. The crucible was maintained at 720° C. during 90 minutes and samples were taken every 30 minutes. The sodium level in the crucible was maintained at a minimal level of 3 ppm during the whole experiment, showing that an addition of a flux comprising NaCl does not involve an absorption of sodium in an aluminum alloy with high magnesium content. The salt flux was prepared from NaCl in powder form and sold under the trademark SIFTO INDUSTRIAL and $MgCl_2$ in flake form and sold under the trademark SKYLINE.

EXAMPLE 3

Prior Art

In a graphite crucible, fifteen grams (15 g) of a salt flux consisting of a ternary mixture of 20 wt % NaCl, 20 wt % KCl and 60 wt % $MgCl_2$ were agitated and added in 1.5 kg of a liquid AA1100 aluminum alloy (sold under the trademark Alcan) in which 5 wt % of magnesium were added. The crucible was maintained at 720° C. during 90 minutes and samples were taken every 30 minutes. The sodium level in the crucible was maintained at a minimal level of 3 ppm during the whole experiment, showing that an addition of a ternary flux comprising a small amount of NaCl does not involve an absorption of sodium in an aluminum alloy with high magnesium content. The salt flux was prepared from NaCl in powder form and sold under the trademark SIFTO INDUSTRIAL, KCl in powder form and sold under the trademark IMC KALIUM and $MgCl_2$ in flake form and sold under the trademark SKYLINE.

EXAMPLE 4

About seventy-five kilos (75 kg) of A356 alloy were melted and maintained in a liquid state at 700° C. in a crucible made of silicon carbide. Then, 535 g of an aluminum alloy containing 10% by weight of calcium were added to the liquid A356 alloy while mixing it with an agitator having straight blades. Then the resulting aluminum alloy contained in the crucible was left without agitation for 5 hours. During this time, the calcium content of the resulting aluminum alloy was reduced from 350 ppm to 150 ppm. Then, three hundred and sixty grams (360 g) of a salt flux made of 45 wt % NaCl and 55 wt % $MgCl_2$ were added to the resulting alloy while agitating it in order to further purify it. The salt flux was prepared from NaCl in powder form and sold under the trademark SIFTO INDUSTRIAL and $MgCl_2$ in flake form and sold under the trademark SKYLINE.

Analyses made on the purified aluminum alloy have shown a reduction of the Ca content from 150 ppm to 70 ppm, that is a reduction of 53%, immediately after the addition of the salt flux, and this Ca content drops to 25 ppm 3 hours after the addition. Also, analyses have shown that the sodium content was in the order of 2 ppm.

EXAMPLE 5

Fifty grams of a flux were prepared in a small alumina crucible by mixing 22.5 grams of NaCl in powder form and sold under the trademark SIFTO INDUSTRIAL, and 27.5 grams of $MgCl_2$ in flake form and sold under the trademark SKYLINE. The mixture was subjected to a temperature of 550° C. during 45 minutes. The liquid mixture obtained was then poured into an enameled-coated bowl for quick solidification. The salt flux obtained was then grinded with in a mortar and sifted. The fraction having a particle size lower than 3150 microns and higher than 105 microns was recovered.

Two kg of AA1100 aluminum alloy (sold under the trademark Alcan) were melted and kept in liquid state at 700° C. in a graphite crucible. To this alloy, 2 grams of an aluminum alloy consisting of 90 wt % of aluminum and 10 wt % of calcium (sold under the trademark KB Alloys) were added in a vortex formed with an agitator in the liquid metal, said agitator having straight blades. The agitation was maintained during 2 minutes. A sample of the metal was taken for analysis. Two grams of the flux formed hereinabove were added to the liquid aluminum alloy doped with calcium while agitating for 2 minutes. Samples were taken immediately after the end of the agitation as well as 30, 60 and 90 minutes later.

Analyses of samples have shown a reduction of the Ca level from 115 ppm to 3 ppm after the addition of the salt flux. Thirty minutes later, the calcium level was under 2 ppm. No increase in the sodium content was noted during the test. The level of sodium in the alloy was in the order of 2 ppm.

EXAMPLE 6

Prior Art

Fifty grams of a salt flux were prepared in a small alumina crucible by mixing 10 grams of NaCl in powder form and sold under the trademark SIFTO INDUSTRIAL, 10 grams of KCl in powder form and sold under the trademark IMC KALIUM, and 30 grams of $MgCl_2$ in flake form and sold under the trademark SKYLINE. The mixture was subjected to a temperature of 550° C. during 45 minutes. The liquid mixture obtained was then poured into an enameled-coated bowl for quick solidification. The salt flux obtained was then grinded in a mortar and sifted. The fraction having a particle size lower than 3150 microns and higher than 105 microns was recovered.

Two kg of AA1100 aluminum alloy (sold under the trademark Alcan) were melted and kept in liquid state at 700° C. in a graphite crucible. To this alloy, 2 grams of an aluminum alloy consisting of 90 wt % of aluminum and 10 wt % of calcium (sold under the trademark KB Alloys) were added in a vortex formed with an agitator in the liquid metal, said agitator having straight blades. The agitation was maintained during 2 minutes. A sample of the metal was taken for analysis. Two grams of the salt flux formed hereinabove were added to the liquid aluminum alloy doped with calcium while agitating for 2 minutes. The agitation was stopped and samples were taken immediately after the end of the agitation as well as 30, 60 and 90 minutes later.

The analysis of samples shows a reduction of the Ca level from 108 ppm to 7 ppm after the addition of the salt flux. Thirty minutes later, the calcium level was at 2 ppm and after 60 minutes the calcium level was under 1 ppm. No increase in sodium content was noted during the test. The sodium level was in the order of 2 ppm. This example shows that a ternary flux having a low content in NaCl does not increase the level of sodium in the alloy.

EXAMPLE 7

Fifty grams of a salt flux were prepared only by mixing 22.5 grams of NaCl in powder form and sold under the trademark SIFTO INDUSTRIAL with a granulometry 95% lower than 840 microns and 95% higher than 300 microns, and 27.5 grams of $MgCl_2$ in flake form and sold under the trademark SKYLINE with a granulometry 90% lower than 4.7 mm and 85% higher to 1 mm.

Two kg of AA1100 aluminum alloy (sold under the trademark Alcan) were melted and kept in liquid phase at 700° C. in a graphite crucible. To this alloy, 2 grams of an aluminum alloy consisting of 90 wt % of aluminum and 10 wt % of calcium (sold under the trademark KB Alloys) were added in a vortex formed with an agitator in the liquid metal, said agitator having straight blades. The agitation was maintained during 2 minutes. A sample of the metal was taken for analysis. Two grams of the salt flux formed hereinabove were added to the liquid aluminum alloy doped with calcium while agitating for 2 minutes. Agitation was stopped and samples were taken immediately after the end of the agitation as well as 30, 60 and 90 minutes later.

Analyses of samples have shown a reduction of the Ca level from 77 ppm to 2 ppm after the addition of the salt flux. Thirty minutes later, the calcium level was under 1 ppm. No increase in the sodium content was noted during the test. The sodium level was in the order of 2 ppm.

EXAMPLE 8

Two kg of AA1100 aluminum alloy (sold under the trademark Alcan) were melted and kept in liquid state at 700° C. in a graphite crucible. To this alloy, 2 grams of an aluminum alloy consisting of 90 wt % of aluminum and 10 wt % of calcium (sold under the trademark KB Alloys) were added in a vortex formed with an agitator in the liquid metal, said agitator having straight blades. Stirring was maintained during 2 minutes. A sample of the metal was taken for analysis. Two grams of the PROMAG SI (trademark) formed of 40 wt % KCl and 60 wt % $MgCl_2$, with a granulometry 99% lower than 3150 microns and 95% higher than 850 microns, were added to the alloy doped with calcium while agitating for 2 minutes. The agitation was stopped and samples were later taken immediately after the end of the agitation as well as 30, 60 and 90 minutes later.

Figure 4:
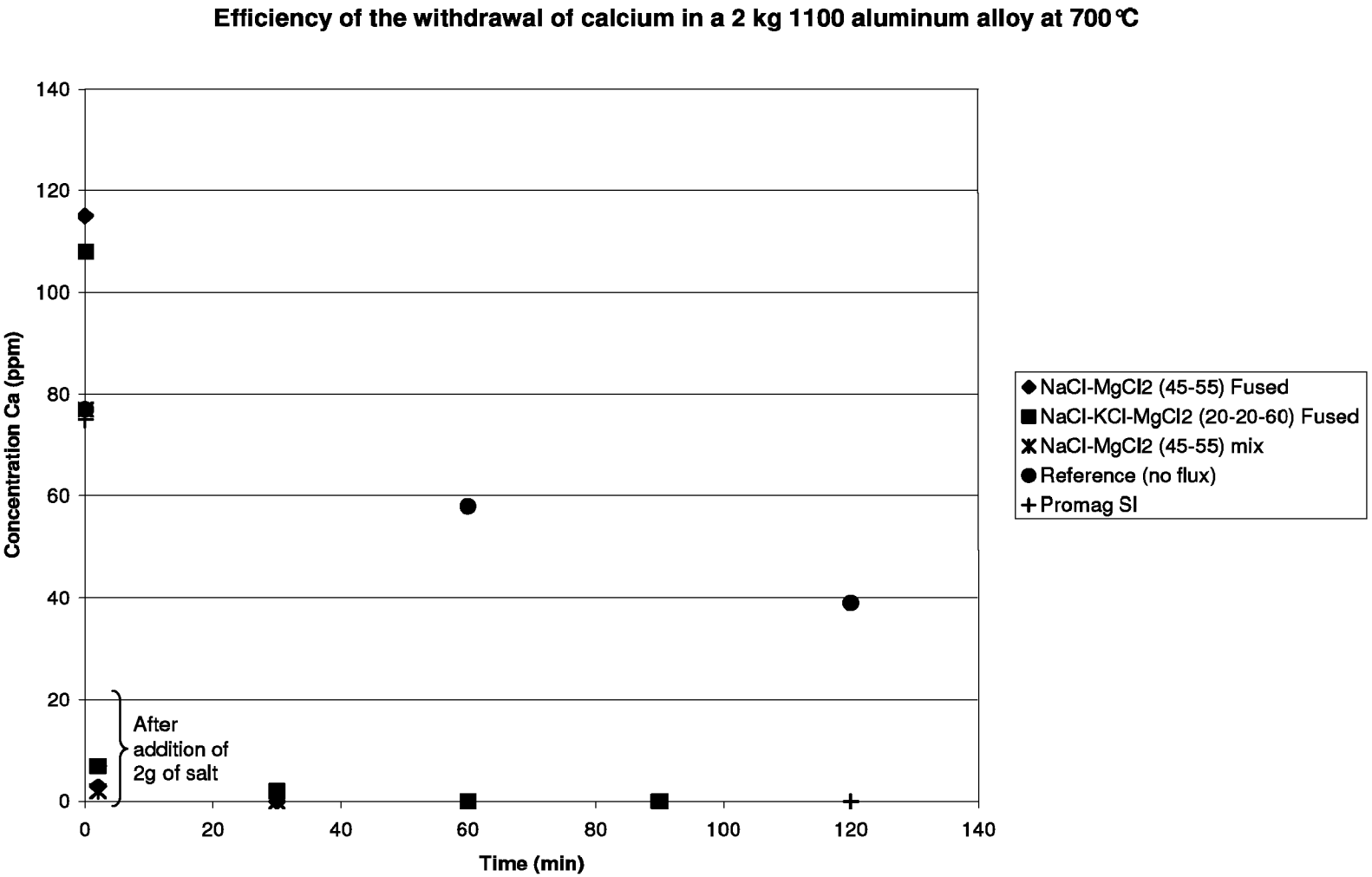
FIG. 4: a comparative graphic concerning examples 5 to 8.

Analyses of samples have shown a reduction of the Ca level from 75 ppm to 7 ppm after the addition of the salt flux. Thirty minutes later the calcium level was under 5 ppm (see FIG. 4). These analyses show that binary fluxes of NaCl and $MgCl_2$ are more efficient than a ternary flux of NaCl, KCl and $MgCl_2$ or a binary flux of KCl and $MgCl_2$.

| Time | Ex. 5 NaCl—$MgCl_2$ (45-55) Fused | Ex. 6 NaCl—KCl—$MgCl_2$ (20-20-60) Fused | Ex. 7 NaCl—$MgCl_2$ (45-55) Mix | Ex. 8 Promag SI* (KCl—$MgCl_2$) (40-60) | Reference (no flux) |
|---|---|---|---|---|---|
| After Ca | 115 | 108 | 77 | 75 | 77 |
| After salt | 3 | 7 | 2 | 7 | — |
| 30 min | <1 | 2 | <1 | <5 | 58 |
| 60 min | <1 | <1 | <1 | <5 | — |
| 90 min | <1 | <1 | <1 | <5 | — |
| 120 min | — | — | — | — | 39 |

*trademark

The present invention has been described with respect to its preferred embodiments. The description and the drawings are only intended to aid to the understanding of the invention and are not intended to limit its scope. It will be clear to those skilled in the art that numerous variations and modifications can be made to the implementation of the invention without being outside the scope of the invention. Such variations and modifications are covered by the present invention. The invention will be now described in the following claims:

What is claimed is:

1. A method for the purification of a metal selected from the group consisting of aluminum and aluminum alloys, wherein said method comprises:

heating the metal to a liquid phase; and contacting the liquid metal with a salt flux consisting of a binary mixture of NaCl and $MgCl_2$, wherein said salt flux is in the form of particles obtained by grinding a fused salt of NaCl and $MgCl_2$.

2. The method according to claim 1, wherein said particles have an average particle size between 100 μm and 3.35 mm.

3. The method according to claim 1, wherein said particles have an average particle size between 0.85 mm and 3.15 mm.

4. The method according to claim 1, wherein said particles have an average particle size between 100 μm and 1 mm.

5. The method according to claim 1, wherein said particles are contacted with the liquid metal by injection with gas injection equipment.

6. The method according to claim 1, wherein the metal is an aluminum alloy having a magnesium content higher than 3% by weight.

7. The method according to claim 1, wherein the metal is an aluminum alloy having a silicon content higher than 10% by weight.

8. A method for the purification of a metal selected from the group consisting of aluminum and aluminum alloys, wherein said method comprises:

heating the metal to a liquid phase; and contacting the liquid metal with a salt flux consisting of a binary mixture of particles comprising:

a) from 22% to 50% by weight of NaCl; and b) from 50% to 78% by weight of $MgCl_2$.

9. The method according to claim 8, wherein the metal is an aluminum alloy having a magnesium content higher than 3% by weight.

10. The method according to claim 8, wherein the metal is an aluminum alloy having a silicon content higher than 10% by weight.

11. A method for the purification of a metal selected from the group consisting of aluminum and aluminum alloys, wherein said method comprises:

heating the metal to a liquid phase; and contacting the liquid metal with a salt flux consisting of a binary mixture of particles comprising:

a) from 40 to 50% by weight of NaCl; and b) from 50 to 60% by weight of $MgCl_2$.

12. The method according to claim 11, wherein said binary mixture comprises:

a) 45% by weight of NaCl; and b) 55% by weight of $MgCl_2$;

to form an eutectic binary mixture having a melting point of about 439° C.

13. The method according to claim 11, wherein said particles have an average particle size between 100 μm and 3.35 mm.

14. The method according to claim 11, wherein said particles have an average particle size between 0.85 mm and 3.15 mm.

15. The method according to claim 11, wherein said particles have an average particle size between 100 μm and 1 mm.

16. The method according to claim 11, wherein said particles are contacted with the liquid metal by injection with gas injection equipment.

17. The method according to claim 11, wherein the metal is an aluminum alloy having a magnesium content higher than 3% by weight.

18. The method according to claim 11, wherein the metal is an aluminum alloy having a silicon content higher than 10% by weight.

19. A method for the purification of a metal selected from the group consisting of aluminum and aluminum alloys, wherein said method comprises:

heating the metal to a liquid phase; and contacting the liquid metal with a salt flux consisting of a binary mixture wherein more than 22% by weight of said binary mixture consists of NaCl, and wherein said salt flux is in the form of particles obtained by grinding a fused salt of NaCl and $MgCl_2$.

20. The method according to claim 19, wherein said binary mixture comprises:

a) from 40 to 50% by weight of NaCl; and b) from 50 to 60% by weight of $MgCl_2$.

21. The method according to claim 20, wherein said binary mixture comprises:

a) 45% by weight of NaCl; and b) 55% by weight of $MgCl_2$;

to form an eutectic binary mixture having a melting point of about 439° C.

22. The method according to claim 19, wherein said particles have an average particle size between 100 μm and 3.35 mm.

23. The method according to claim 19, wherein said particles have an average particle size between 0.85 mm and 3.15 mm.

24. The method according to claim 19, wherein said particles have an average particle size between 100 μm and 1 mm.

25. The method according to claim 19, wherein said particles are contacted with the liquid metal by injection with gas injection equipment.

26. The method according to claim 19, wherein the metal is an aluminum alloy having a magnesium content higher than 3% by weight.

27. The method according to claim 19, wherein the metal is an aluminum alloy having a silicon content higher than 10% by weight.

28. A method for the purification of a metal selected from the group consisting of aluminum and aluminum alloys, wherein said method comprises:

heating the metal to a liquid phase; and contacting the liquid metal with a salt flux consisting of a liquid binary mixture of NaCl and $MgCl_2$, wherein more than 22% by weight of said binary mixture consists of NaCl.

29. The method according to claim 28, wherein the metal is an aluminum alloy having a magnesium content higher than 3% by weight.

30. The method according to claim 28, wherein the metal is an aluminum alloy having a silicon content higher than 10% by weight.

31. A method for the purification of a metal selected from the group consisting of aluminum and aluminum alloys, wherein said method comprises:

heating the metal to a liquid phase; and contacting the liquid metal with a salt flux consisting of a liquid binary mixture of NaCl and $MgCl_2$ comprising:

a) from 40 to 50% by weight of NaCl; and b) from 50 to 60% by weight of $MgCl_2$.

32. The method according to claim 31, wherein the liquid binary mixture comprises:

a) 45% by weight of NaCl; and b) 55% by weight of $MgCl_2$.

33. The method according to claim 31, wherein the metal is an aluminum alloy having a magnesium content higher than 3% by weight.

34. The method according to claim 31, wherein the metal is an aluminum alloy having a silicon content higher than 10% by weight.

* * * * *